United States Patent [19]

Cullis

[11] Patent Number: 4,892,207

[45] Date of Patent: Jan. 9, 1990

[54] BOTTLED WATER CONTAINER

[75] Inventor: Michael D. Cullis, Middletown, N.J.

[73] Assignee: The Perrier Group of America, Inc., Greenwich, Conn.

[21] Appl. No.: 173,925

[22] Filed: Mar. 28, 1988

[51] Int. Cl.[4] ..... B65D 21/02; B65D 23/10; B65D 23/14

[52] U.S. Cl. ..... 215/100 A; 215/10; 220/94 R

[58] Field of Search ..... 215/1 C, 10, 100 A, 215/100 R; 220/94 R, 94 A; D9/367, 370, 378, 374; 294/27.1, 31.2

[56] References Cited

U.S. PATENT DOCUMENTS

| | | | |
|---|---|---|---|
| D. 288,293 | 2/1987 | Arvans | D9/378 X |
| 3,386,617 | 6/1968 | Shankland, Sr. | 220/94 R |
| 3,889,834 | 6/1975 | Harris, Jr. | 215/10 |
| 4,257,525 | 3/1981 | Thompson | 220/94 R |
| 4,301,935 | 11/1981 | Gokcen et al. | 215/100 A |
| 4,308,955 | 1/1982 | Schieser et al. | 215/10 X |
| 4,363,415 | 12/1982 | Rainville | 215/100 A |
| 4,805,808 | 2/1989 | Larson | 220/94 A X |

FOREIGN PATENT DOCUMENTS

| | | | |
|---|---|---|---|
| 2434283 | 1/1976 | Fed. Rep. of Germany | 220/94 A |
| 889343 | 2/1962 | United Kingdom | 215/1 C |
| 923151 | 4/1963 | United Kingdom . | |
| 1179628 | 1/1970 | United Kingdom . | |

*Primary Examiner*—Sue A. Weaver
*Attorney, Agent, or Firm*—Kuhn and Muller

[57] ABSTRACT

A bottled water container for a water cooler of the type in which the container is supported upon the water cooler for selective removal and replacement, the bottled water container having a handle straddling a recess located in the body of the container at the intersection of the side wall and the upper end wall of the container body and bridging a gap created by the recess in the peripheral edge along the intersection of the side wall and the upper end wall of the container, such that the container is lifted readily by the handle and easily upended for facilitating placement of the container in proper position in the water cooler. The handle is hollow and molded separate from the body of the container and is integrated with the container body such that the interior of the handle is isolated from the interior of the container body for ready cleaning of the interior of the container, enabling practical reuse of the bottled water container.

24 Claims, 4 Drawing Sheets

BOTTLED WATER CONTAINER

The present invention relates generally to water containers and pertains, more specifically, to bottled water containers for use in connection with water coolers of the type in which the bottled water container is supported upon the water cooler for selective removal and replacement, as necessary for the maintenance of a water supply.

Water coolers long have been a familiar fixture in offices and factories and have provided a convenient source of drinking water made available readily at a wide variety of locations. More recently, water coolers of the type which utilize bottled water have gained increased popularity, and that popularity is spreading to home use, as well as commercial and industrial use, as bottled water becomes preferred over community water supplies for drinking purposes. It has become desirable to have available in these various locations a reliable source of pleasant and healthful drinking water, with a minimum of complexity and expense.

One of the drawbacks of water coolers of the type which utilize bottled water is the degree of difficulty in handling the replacement containers. These containers usually are supplied in the form of relatively large, heavy bottles of drinking water which must be transported to the site, stored and manipulated into position in a water cooler. In larger commercial and industrial organizations, personnel usually are available to assist in replenishing the bottled water containers of water coolers; however, in smaller offices and other limited facilities, as well as in homes, the handling of bottled water for a water cooler must be accomplished by individuals who may not be able easily to manipulate such a heavy item.

The present invention provides a more manageable bottled water container for water coolers, while at the same time enabling increased strength and economy in such replaceable containers for more practical widespread use of water coolers of the type which utilize bottled water. The following is a summary of some of the objects and advantages of the present invention: Ease of handling, particularly when manipulating a full bottled water container into place upon a water cooler; better handle configuration and placement for convenience of storage as well as increased ease of handling and economical manufacture; the elimination of hard-to-reach and concomitantly hard-to-clean internal passages and crevices for ease of cleaning for reuse; an aesthetically pleasing container configuration which is manufactured economically of commonly available synthetic plastic materials; compatibility with most water coolers currently in use in the field; and capable of manufacture in large quantities of consistent high quality.

The above objects and advantages, as well as further objects and advantages, are attained by the present invention which may be described briefly as a bottled water container for a water cooler of the type in which the container is supported upon the water cooler for selective removal and replacement, the container being supported upon the water cooler in an orientation up-ended with respect to the orientation of the container during storage and transportation of the container, the bottled water container comprising: a container body having a longitudinally extending side wall, a transverse lower end wall, a feed neck in the lower end wall, and a transverse upper end wall opposite the lower end wall and intersecting the side wall along an upper peripheral edge, the side wall, lower end wall and upper end wall providing the container body with an overall envelope configuration; a recess in the container body, the recess extending into the container body, inwardly of the overall envelope configuration, between the side wall and the upper end wall, so as to establish a gap in the upper peripheral edge; a handle straddling the recess and aligned essentially along the gap in the upper peripheral edge so as to bridge the gap, such that the handle may be gripped by a hand entering the recess to extend around the handle for up-ending the container from a first orientation, where the container rests upon either one of the side wall and the upper end wall, to a second orientation, up-ended relative to the first orientation, in which second orientation the upper end wall is uppermost and the container rests upon the water cooler with the lower end wall juxtaposed with the water cooler.

The invention will be understood more fully, while still further object and advantages will become apparent, in the following detailed description of a preferred embodiment of the invention illustrated in the accompanying drawing, in which.

Figure 1:
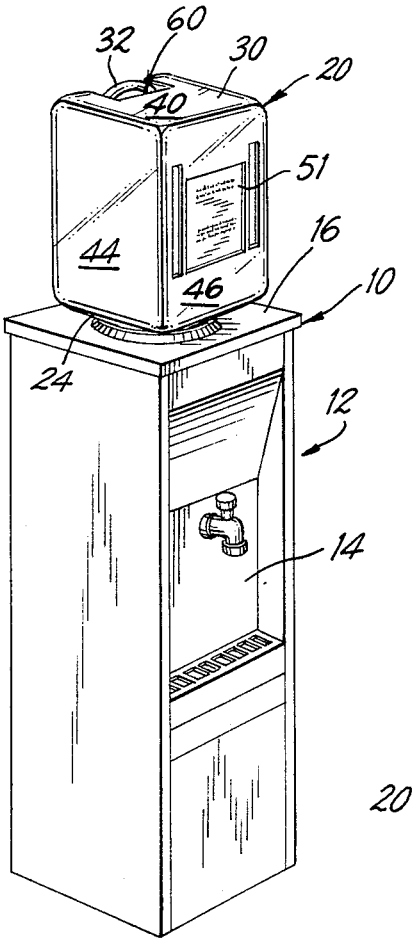
FIG. 1 is a front perspective view of a water cooler of the type which utilizes a bottled water container constructed in accordance with the invention.
Figure 2:
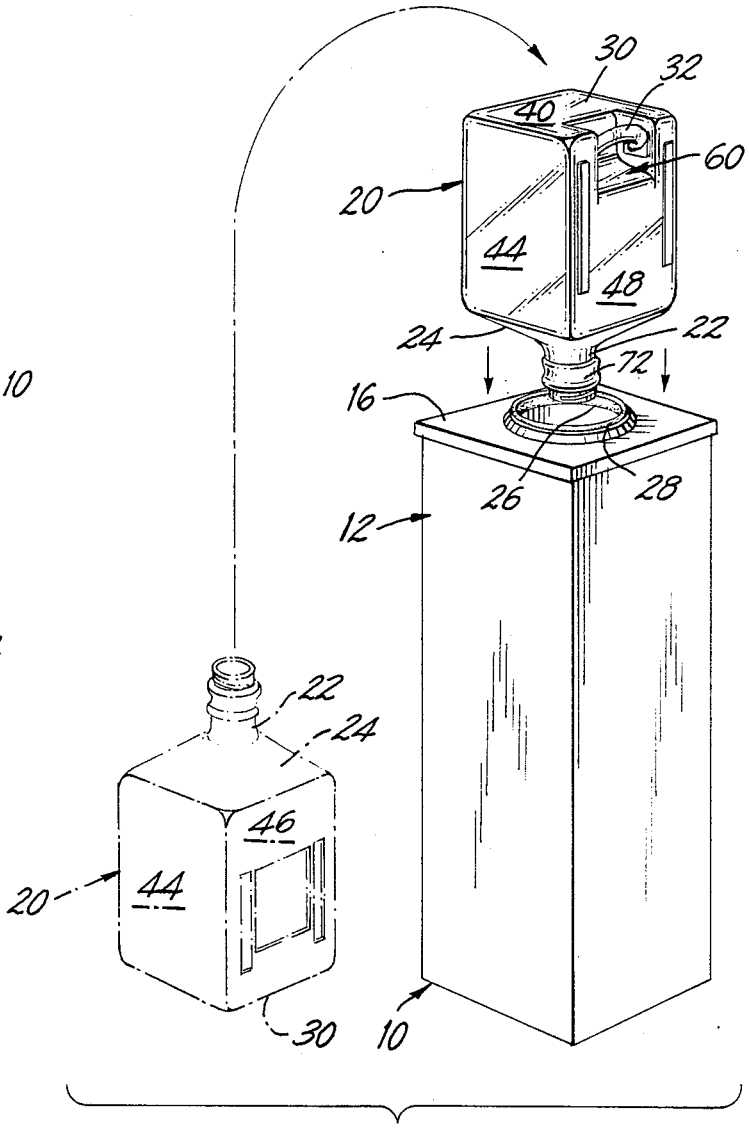
FIG. 2 is an exploded rear perspective view of the water cooler and bottled water container of FIG. 1.
Figure 8:
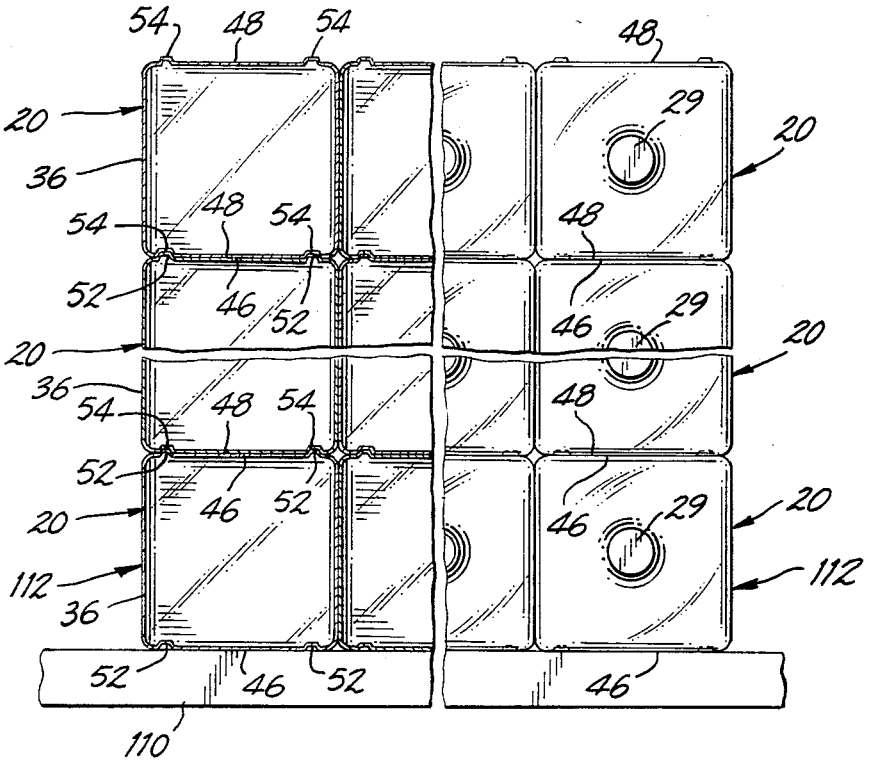
FIG. 8 is a largely diagrammatic, front elevational view demonstrating an arrangement of bottled water containers in a stack for storage and transportation.
Figure 9:
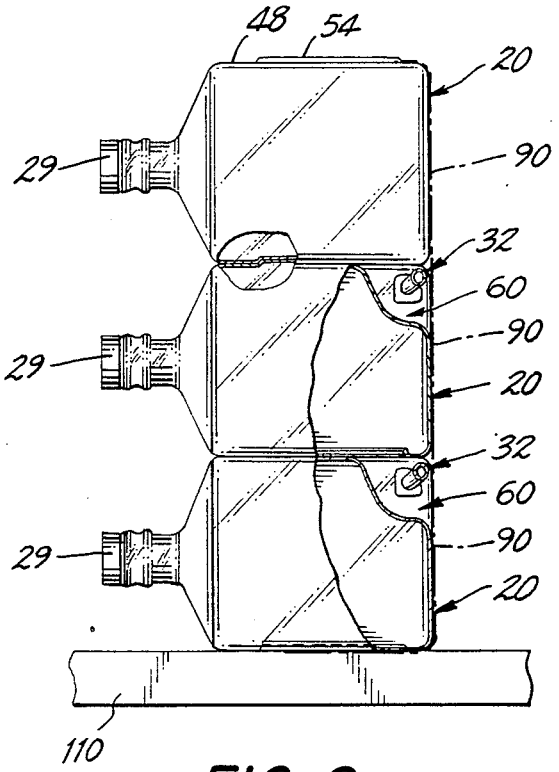
FIG. 9 is a side elevational view of a portion of the stack of FIG. 8.

Referring now to the drawing, and especially to FIGS. 1 and 2 thereof, a water cooler 10 is seen to have a housing 12 which includes a dispensing station 14 for dispensing drinking water upon demand. Water cooler 10 is of the type in which a bottled water container is supported upon the water cooler, at the top 16 of the housing 12, for selective removal and replacement to maintain a supply of drinking water. In this instance, the bottled water container is in the form of container 20 constructed in accordance with the invention. When in use, container 20 is seated upon the top 16 of the housing 12 of water cooler 10 and supplies drinking water to the dispensing station 14 through a feed neck 22 located at the lower end 24 of the container 20. Feed neck 22 extends through an opening 26 in the top 16 of housing 12 and the container 20 is supported upon the rim 28 of the opening 26. When not in use, container 20 ordinarily is capped with a screw cap 29 (see FIGS. 8 and 9) and is stored either on one side, as seen in FIGS. 8 and 9, or in a inverted position, as illustrated in phantom in FIG. 2, with the container 20 resting upon the upper end 30 thereof, awaiting installation in the water cooler 10.

Such installation requires that the container 20 be lifted over the top 16 of the housing 12, while at the same time being inverted, or up-ended, so that the lower end 24 of the container 20 will be presented to the top 16 of the housing 12 and feed neck 22 will be inserted through the opening 26 to rest the lower end 24 of the container 20 upon the rim 28 of the opening 26. These manipulations of the container 20 must be accomplished, of course, when the container 20 is filled with drinking water and is at a maximum weight.

Figure 3:
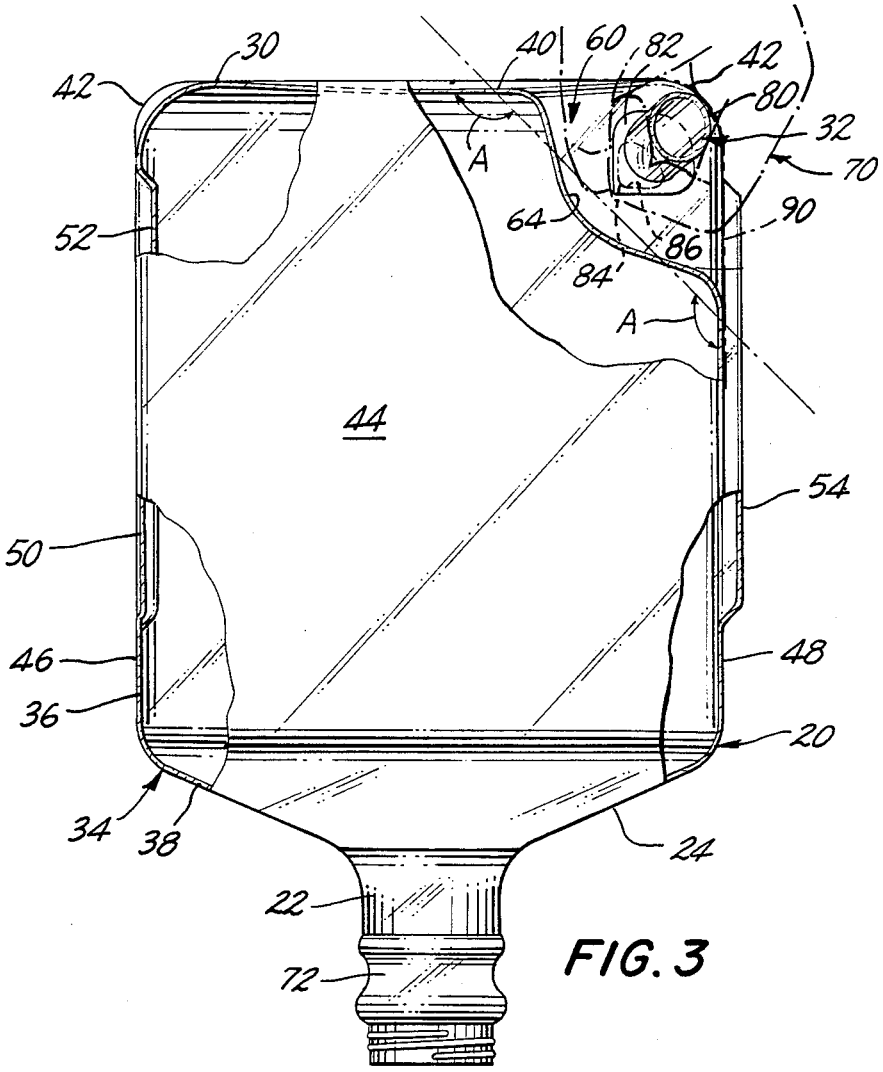
FIG. 3 is a side elevational view, partially sectioned, of the bottled water container.
Figure 4:
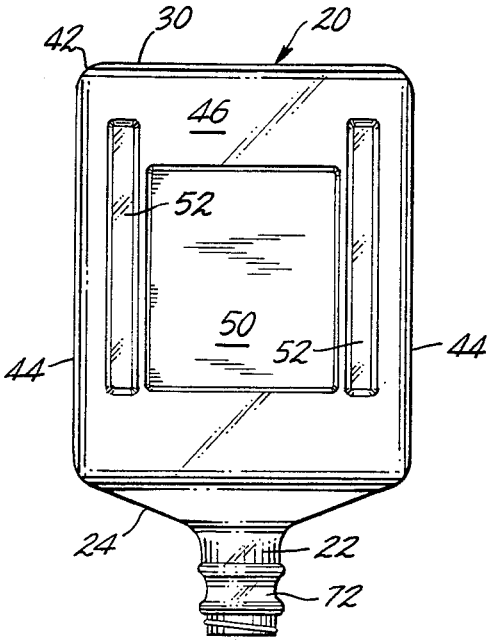
FIG. 4 is a front elevational view of the bottled water container.
Figure 5:
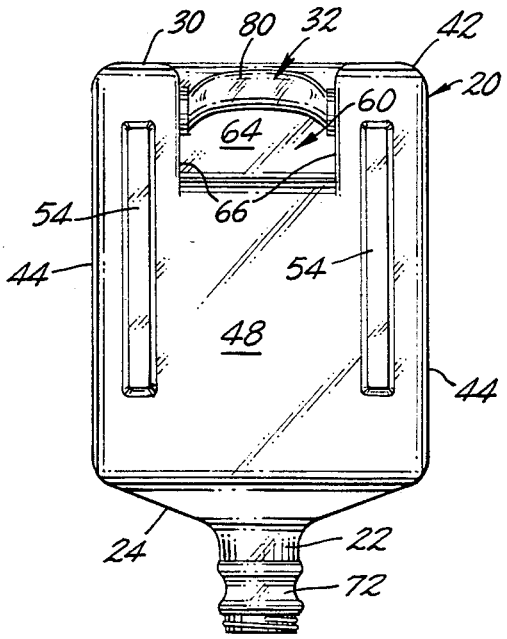
FIG. 5 is a rear elevational view of the bottled water container.

In order to facilitate the above-described manipulation of the container 20, the container 20 is provided with a handle 32 located at the upper end 30. As best seen in FIG. 3, container 20 has a relatively thin-walled hollow body 34, preferably constructed by blow molding from a synthetic plastic, such as polycarbonate. Body 34 includes a side wall 36 extending longitudinally between a transverse lower end wall 38, which carries the feed neck 22, and a longitudinally opposite transverse upper end wall 40, which intersects the side wall 36 along an upper peripheral edge 42. Preferably, the side wall 36 has a polygonal cross-sectional configuration and includes opposite side panels 44, a front panel 46 and a rear panel 48 opposite the front panel 46. In the illustrated embodiment, the cross-sectional configuration is rectangular, with the side, front and rear panels 44, 46 and 48 being substantially flat and forming an essentially square cross-sectional shape. As best seen in FIG. 4, the front panel 46 includes a debossed portion 50 provided for the reception of a label 51 (see FIG. 1), and a pair of parallel grooves 52 extending inwardly into the container body 34 and longitudinally along the front panel 46. As seen in FIG. 5, the rear panel 48 includes a pair of parallel ribs 54 extending outwardly out of the container body 34 and longitudinally along the rear panel 48, the ribs 54 being generally complementary to the grooves 52 for purposes which will be explained in detail hereinafter.

Figure 6:
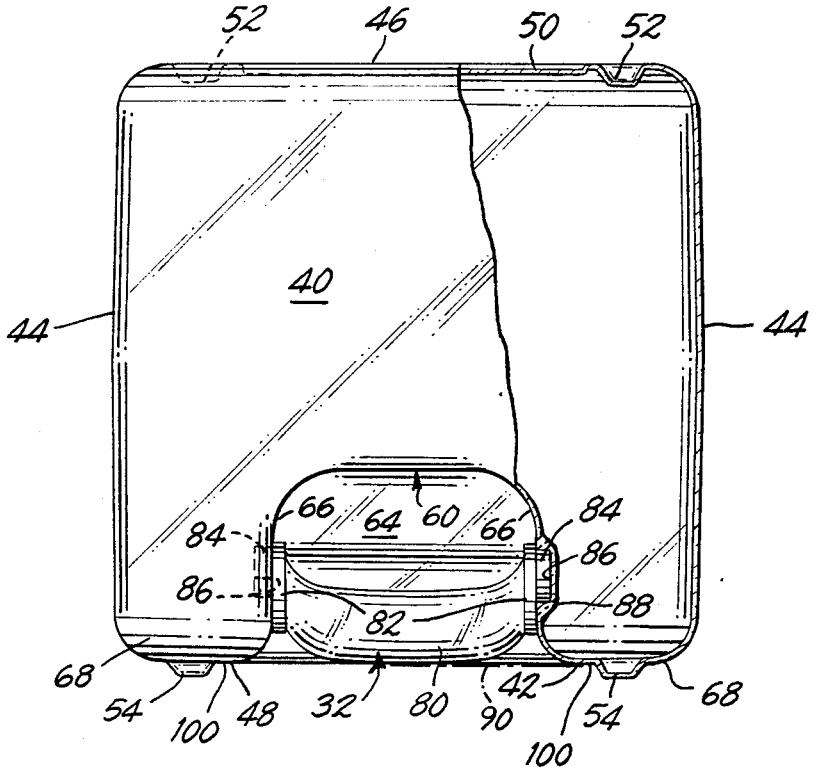
FIG. 6 is a top plan view, partially sectioned, of the bottled water container.
Figure 7:
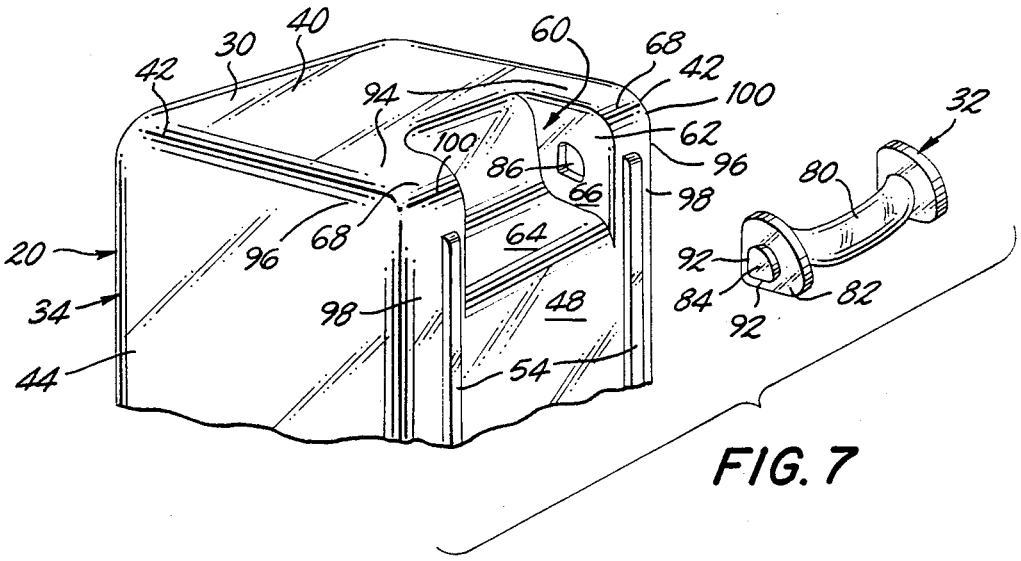
FIG. 7 is a fragmentary perspective view of a portion of the bottled water container, with the handle moved out of the recess in the bottled water container.

Turning now to FIGS. 6 and 7, as well as to FIG. 3, a recess 60 extends into the container body 34 between the rear panel 48 and the upper end wall 40 and establishes a gap 62 in the peripheral edge 42 of the container body 34. The recess 60 is bounded by a recess bottom wall 64, which extends between the rear panel 48 and the upper end wall 40, and opposite recess end walls 66 located at either end of the gap 62. The recess end walls 66 are each spaced laterally from a corresponding side panel 44 so as to be located on shoulder portions 68 in the container body 34 at the opposite ends of the gap 62. Handle 32 is secured to the container body 34 between the shoulder portions 68 and bridges the gap 62 in the peripheral edge 42. In this manner, the handle 32 may be grasped by a hand, illustrated in phantom at 70 in FIG. 3, which hand enters the recess 60 to extend around the handle 32 for a firm grip upon the container 20 at a location on the container body 34 which facilitates lifting the container 20 and up-ending the container 20, while so held, to enable greater ease in placing the container 20 in position upon the water cooler 10. The lifting and up-ending of the container 20 is facilitated further by the inclusion of an auxiliary fingergrip 72 at the feed neck 22.

In view of the weight which must be lifted and manipulated by gripping handle 32, the handle 32 must be so constructed and so integrated with the container body 34 as to provide sufficient strength for such service. Further, in order to render the container 20 suitable for reuse, the interior of the container body 34 must be capable of easy cleansing between reuses. Thus, the interior contours of the container 20 should be free of any nooks, crannies or other crevices or passages which could harbor foreign matter and elude cleaning by conventional container cleaning techniques. Accordingly, the handle 32 is constructed separately and is joined to the container body 34 subsequently in order to provide an integrated structure which possesses the required strength and to isolate the handle structure from the interior of the container 20. Handle 32 preferably is hollow and made by blow molding of a synthetic plastic, such as polycarbonate, and subsequently is placed within the appropriate blow molding die where the container body 34 is molded and simultaneously integrated with the handle 32. Handle 32 includes a central handgrip portion 80 which extends between opposite end pads 82. Each end pad 82 includes a projection 84 which is lodged in a complementary socket 86 formed in the corresponding recess end wall 66 of each shoulder portion 68 of the container body 34 to affix and secure the handle 32 in place, bridging the gap 62 in the peripheral edge 42. The procedure by which the container body 34 is molded into an integral relationship with the handle 32 not only assures a tight fit between the corresponding projections 84 and sockets 86, but enables the interior of container body 34 in the vicinity of the pads 82, as shown at 88, to be free of any crevices which otherwise could accumulate and trap unwanted foreign matter. At the same time, partition means is provided at 88, by which means the hollow interior of handle 32 is closed off and isolated from the interior of the container body 34, thereby eliminating any hard-to-clean passages which might otherwise be presented by the presence of a hollow handle. Thus, in contrast to the construction of blow-molded bottles in which a hollow handle is unitary with the bottle body and the interior of the remainder of the bottle body, rendering the bottle difficult to clean internally and therefore impractical for reuse, the present construction eliminates all communication between the interior of the hollow handle 32 and the interior of the container body 34, thereby eliminating any concomitant hard-to-clean passages and crevices and rendering the container 20 practical for reuse.

The handgrip portion 80 of handle 32 is arched and the arched configuration provides several advantages. Thus, the arched configuration lends added resistance to bending of the handle 32, thereby increasing the load bearing capabilities of the handle. Further, the end pads 82 are spaced inwardly away from the peripheral edge 42 so that the sockets 86 advantageously are spaced away from the intersection of the various wall sections of the shoulder portions 68, thereby enabling the placement of sufficient material surrounding the sockets 86 to reinforce the connection between the sockets 86 and the projections 84 and the securement of the handle 32, and facilitating the molding of the container body 34 integral with the handle 32. At the same time, the handgrip portion 80 of the handle 32 remains confined within the overall envelope configuration of the container body 34, as illustrated by the phantom outline at 90 in FIGS. 3 and 6, and in FIG. 9, for purposes which will be described below, while sufficient clearance is maintained within the recess 60, between the handgrip portion 80 and the recess bottom wall 64, for insertion of the hand 70 into the recess 60 to extend around the handle 32. With respect to the provision of sufficient clearance in the recess 60, it is noted that the recess bottom wall 64 is concave, that is, curved inwardly somewhat, to increase the space between the handgrip portion 80 of handle 32 and the recess bottom wall 64 for even greater clearance. Thus, while the recess bottom wall 64 nominally makes an obtuse angle A of approximately 135° with the rear panel 48 and with the upper end wall 40, the concave configuration of the recess bottom wall 64 increases the clearance over that which would be provided by a straight recess bottom wall.

Effective anchoring of the handle 32 within the shoulder portions 68 of the container body 34 is enhanced by providing the projections 84 and, consequently, the complementary sockets 86 with a sector-like peripheral configuration including orthogonal flats 92 which lock each projection 84 against rotation within the corresponding socket 86. Thus, the sector-like peripheral configuration conserves material and space, while achieving superior anchoring of the handle 32 as an integral part of the container 20. The shoulder portions 68 themselves include not only the recess end walls 66, but adjacent wall portions 94 of the upper end wall 40, wall portions 96 of the side panels 4 and wall portions 98 of the rear panel 48. These wall portions 94, 96 and 98 are in relatively close proximity and, along with recess end walls 66, all intersect a corresponding segment 100 of the peripheral edge 42 and establish strong corners which serve to reinforce one-another in providing the shoulder portions 68 with the requisite strength and rigidity to support handle 32. In this connection, the width of the recess 60, and consequently the width of gap 62, preferably is made less than about one-half the width of the container body 34 between side panels 44, and the recess 40 is located centrally between the side panels 44. The handle 32 bridges the gap 62 in the upper peripheral edge 42 and reinforces the container body 34 by essentially eliminating any structural discontinuity about the periphery of the container body coincident with upper peripheral edge 42.

Referring now to FIGS. 8 and 9, the storage and transportation of multiple containers 20 is accomplished effectively by stacking multiple containers 20 upon a single pallet or skid, illustrated at 110. The stack 112 of containers 20 is made compact and stable by the rectangular cross-sectional configuration of the side walls 36 of the individual containers 20. Stability of the stack 112 is enhanced by the engagement of the ribs 54 of one container 20 with the corresponding grooves 52 of the next adjacent container 20 in the stack 112, while dimensional consistency of the stack 112 is facilitated. By assuring that the handle 32 remains within the overall envelope configuration 90 of the container body 34, the handle 32 does not interfere with stacking the containers 20 in close juxtaposition with one another in the most compact manner.

The placement of the handle 32 within the gap 62 in the peripheral edge 42 of the container body 34 attains several advantages. First, the handle 32 is positioned for ease of handling the weight of a water-filled container 20 and up-ending the container 20 for proper placement in the water cooler 10. Additionally, the handle 32 is placed at a location in the container body 34 where the handle 32 is structurally integrated with the container body 34 with sufficient strength to withstand the rigors of handling the weight of a water-filled container 20. Thus, the handle 32 is anchored in sockets 86 placed within recess end walls 66 which are reinforced by the structural configuration of each shoulder portion 68, as explained above, so as to provide maximum structural strength with the minimum of material and the least intrusion into the interior capacity of the container 20. Further, the alignment of the handle 32 with the remainder of the upper peripheral edge 42 fills the gap 62 in the peripheral edge 42 and reinforces the container body 34 in the vicinity of the recess 60, especially when the container 20 rests upon the upper end wall 40, as illustrated in phantom in FIG. 2. Accordingly, the location of handle 32 enables the construction of a relatively compact, high strength container 20 which is easy to store, transport and handle, and is economically manufactured for widespread use.

Container 20 may be constructed in various sizes to accommodate different volumes of drinking water. One manageable size container 20, from the standpoint of dimensions and weight, has a width and a depth of about eight and one-half inches and an overall height of about fourteen and one-quarter inches, and accommodates approximately three gallons of drinking water. Other sizes are contemplated.

It is to be understood that the above detailed description of a preferred embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. A container for liquids comprising a body portion and a feed neck opening at one end whereby liquid enters or exits from the container substantially in the direction of its longitudinal axis, a recess formed adjacent an end portion of the container body opposite said feed neck opening and having its major axis oriented generally transverse to but not intersecting the longitudinal axis of the container, and a handle straddling said recess in a direction substantially parallel to the major axis of said recess whereby said handle may be gripped by a hand entering said recess to extend around the handle for up-ending the container from an upright orientation to a feed orientation.

2. The container of claim 1 in which said feed neck opening is on the longitudinal axis of the container and said recess is laterally displaced therefrom.

3. The container of claim 1 in which said recess and said feed neck opening are on opposite sides of the rotational axis of the container about which the container pivots when moved from said upright orientation to said feed orientation.

4. The container of claim 1 in which the position of said recess and handle are such that when the container is held by said handle said feed neck opening faces in a downward direction.

5. The container of claim 1 comprising a longitudinally extending side wall and a transverse upper end wall opposite said feed neck opening and intersecting the side wall along an upper peripheral edge.

6. The container of claim 1 in which said handle is affixed at each end to a respective side wall of said recess, each of said recess side walls extending in a direction generally parallel to the longitudinal axis of the container.

7. The invention of claim 5 wherein:

the container body has a polygonal cross-sectional configuration and the side wall comprises a plurality of panels, including a front panel, a rear panel opposite the front panel, and laterally opposite side panels defining the width of the container body; and the recess extends between the rear panel and the upper end wall.

8. The invention of claim 7 wherein:

the recess is spaced laterally from each of the side panels; and the container body includes shoulder portions at either side of the recess, the recess being located between said shoulder portions.

9. The invention of claim 8 wherein the recess extends laterally less than approximately one-half the width of the container body between the side panels, and said shoulder portions extend laterally throughout the remainder of the width.

10. The invention of claim 9 including handle attachment means in said shoulder portions of the container body, the handle attachment means being spaced inwardly slightly from the upper peripheral edge.

11. The invention of claim 10 wherein the handle is arched outwardly from said recess and includes a handgrip portion aligned with the upper peripheral edge.

12. The invention of claim 11 including a feed neck and an auxiliary fingergrip on the feed neck.

13. The invention of claim 7 including a recess wall portion extending between the rear panel and the upper end wall, the recess wall portion nominally making an obtuse angle with each of the rear panel and the upper end wall.

14. The invention of claim 13 wherein the obtuse angle is about 135°.

15. The invention of claim 13 wherein the recess wall portion is concave and curved inwardly along a substantial portion thereof.

16. The invention of claim 7 wherein the polygonal cross-section is a rectangle.

17. The invention of claim 7 wherein the handle is arched in an outward direction from said recess.

18. The invention of claim 17 including handle attachment means in the container body, the handle attachment means being spaced inwardly slightly from the upper peripheral edge.

19. The invention of claim 18 wherein the handle extends between opposite ends and includes projections at each of the opposite ends, and the handle attachment means includes sockets in the container body, the sockets being complementary to the projections.

20. The invention of claim 19 wherein the projections, and the complementary sockets, have a sector-like configuration, including flats along the sector-like configuration for precluding rotational movement of the handle relative to the container body.

21. The invention of claim 1 including an auxiliary handgrip on the feed neck.

22. The invention of claim 1 wherein the container body includes an interior, the handle is hollow and includes an interior, and the container body further includes means for isolating the interior of the handle from the interior of the container.

23. The invention of claim 22 including handle attachment means in the container body, the handle attachment means being spaced inwardly slightly from an upper peripheral edge of said container body.

24. The invention of claim 23 wherein the handle is arched outwardly from said recess and includes a handgrip portion aligned with said upper peripheral edge.

* * * * *